US007579995B1

(12) United States Patent
Theunissen et al.

(10) Patent No.: US 7,579,995 B1
(45) Date of Patent: Aug. 25, 2009

(54) NEAR FIELD NULLING ANTENNA SYSTEMS

(75) Inventors: Wilhelmus H. Theunissen, Bensalem, PA (US); Anthony W. Jacomb-Hood, Yardley, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 262 days.

(21) Appl. No.: 11/830,725

(22) Filed: Jul. 30, 2007

(51) Int. Cl.
*H01Q 11/12* (2006.01)

(52) U.S. Cl. ..... 343/742; 343/741; 343/867; 343/895

(58) Field of Classification Search ..... 343/741, 343/742, 844, 866, 867, 895
See application file for complete search history.

(56) References Cited

U.S. PATENT DOCUMENTS

| | | | | |
|---|---|---|---|---|
| 6,388,628 | B1 * | 5/2002 | Dettloff et al. | 343/742 |
| 6,486,844 | B2 * | 11/2002 | Thursby et al. | 343/744 |
| 7,423,606 | B2 * | 9/2008 | Knadle et al. | 343/819 |
| 2002/0024473 | A1 * | 2/2002 | Thursby et al. | 343/741 |

OTHER PUBLICATIONS

Ellingson et al.; Efficient Multibeam Synthesis With Interference Nulling for Large Arrays; IEEE Transactions on Antennas and Propagation; Mar. 2003; pp. 503-511; vol. 51, No. 3.

Fienup; Reconstruction of an Object from the Modulus of its Fourier Transform; Optics Letters: Jul. 1978; pp. 27-29; vol. 3, No. 1.

Fienup; Phase Retrieval Algorithms: A Comparison; Applied Optics; Aug. 1, 1982; pp. 2758-2769; vol. 21, No. 15.

Welsh et al.; Phase Retrieval-Based Algorithms for Far Field Beam Steering and Shaping. Proc. SPIE, Aug. 1999; pp. 11-22; vol. 3763.

Stone et al.; Far Field Beam Shaping and Steering Using Phase Retrieval-Based Wavefront Control; Proc. SPIE, Aug. 2000; pp. 212-222; vol. 4124.

Theunissen et al.; A Contour Beam Synthesis Method Using The Generalized Phase Retrieval Method; IEEE Antennas and Propagation Society International Symposium 2003; Jun. 2003; pp. 766-769; vol. 2.

* cited by examiner

*Primary Examiner*—Douglas W. Owens
*Assistant Examiner*—Chuc Tran
(74) *Attorney, Agent, or Firm*—McDermott Will & Emery LLP

(57) ABSTRACT

An antenna system is provided. The antenna system comprises a first antenna with a first operating frequency and a second antenna with a second operating frequency. The second antenna has a first near field with a first near region in which the first antenna is disposed and a second near region. The second antenna has a first gain in the first near region which is lower than a second gain in the second near region. The first gain and the second gain are both at a same one of the first operating frequency and the second operating frequency.

22 Claims, 14 Drawing Sheets

Main beam steered to (60°,45°)

Grating lobe region

NEAR FIELD NULLING ANTENNA SYSTEMS

CROSS-REFERENCE TO RELATED APPLICATION

Not applicable.

STATEMENT REGARDING FEDERALLY SPONSORED RESEARCH OR DEVELOPMENT

Not applicable.

FIELD OF THE INVENTION

The present invention generally relates to antenna systems and, in particular, relates to antenna systems utilizing near field nulling.

BACKGROUND OF THE INVENTION

A major challenge in the design of full duplex communications systems (i.e., systems which simultaneously transmit and receive) is self jamming. One kind of self jamming occurs when transmit power leaks within the transmit frequency band into the receive path. If the leakage signal power level is sufficiently high, it may degrade the performance of the receive subsystem in one or more ways. For example, it may drive the receive path components into compression and thus reduce sensitivity. Moreover, depending on the receive down-conversion frequency plan, the transmit power or a spur formed in the receive chain may end up in one of the intermediate frequency (IF) bands, directly adding noise and thus reducing receive sensitivity. One approach to guarding against this form of self jamming involves placing a filter at the input to the receive chain prior to the first active component (typically a low noise amplifier, or sometimes a mixer). This filter highly attenuates power in the transmit band whilst providing low loss to signals in the receive band.

Another kind of self jamming involves the leakage of spurious power generated by the transmitter which falls inside the receive band. If this power couples into the receive path, it adds directly to the noise in the receive path, thereby degrading receive sensitivity. One approach to guarding against this form of self jamming involves providing a filter at the output of the transmitter. This filter highly attenuates power in the receive band while providing low loss to signals in the transmit band. The filter must be placed after the last stage of transmit amplification, as this stage is commonly a major contributor to the generation of spurs (as it tends to be operated at or close to saturation to achieve reasonable efficiency).

High isolation filters introduce undesired attenuation in their pass band degrading satellite transmit capability (EIRP) and satellite receive sensitivity (G/T). Techniques utilized to offset these degradations (e.g., higher transmit power, higher antenna gain) increase satellite mass and cost. Moreover, these filters tend to be both heavy and expensive.

Other approaches to guarding against self jamming involve physically separating the transmit and receive hardware to provide spatial isolation. In some satellite systems, the total required isolation at both the transmit and receive frequencies to prevent self jamming is in the range of 100 to 150 dB. This isolation requirement is a system design driver and also drives system cost and mass. In satellite systems providing separate transmit and receive antenna systems, it increases cost and mass (which in turn increases launch cost) because two antennas must be procured and accommodated on the satellite. Designing a satellite to place two antennas far apart (to increase spatial isolation) also increases satellite mass and cost.

Other communications systems which use active phased arrays to achieve improved system flexibility/capability must also guard against self jamming. Phased arrays use a plurality of radiating elements with associated filters, amplifiers and phase/amplitude control devices to form beams whose direction and shape are defined by commanding the phase/amplitude control devices to appropriate phase/amplitude states. The spacing between the radiating elements is determined by the required beam scan. For example, in systems requiring high beam scan (e.g., >45° scan), the elements are typically placed ~0.5 wavelengths apart. For systems requiring less beam scan (e.g., geostationary communications satellites requiring 5-9° scan) the elements are typically placed ~2 to 3 wavelengths apart. The combination of this spacing constraint with the large number of radiating elements and associated electronics paths in a phased array limits the isolation level available from practical filters. In some high beam scan systems (e.g., systems using the SHF geostationary satellite communications band: 7.25-7.75 GHz downlink and 7.9-8.4 GHz uplink), the separation between the transmit and receive frequencies is so small that no filter with useful isolation can be fitted within the array radiating element grid. Accordingly, these systems rely entirely on spatial separation to provide the required isolation.

SUMMARY OF THE INVENTION

According to one aspect, the present invention provides improved isolation between transmit and receive phased arrays by utilizing a technique to prevent or alleviate self jamming and/or interference suppression for transmit and receive antennas and antenna arrays in close proximity. The transmit and receive antennas and antenna arrays may operate in or close to the same frequency band. A near field nulling technique reduces the coupling between two antennas and/or antenna arrays in close proximity.

According to one embodiment of the present invention, an antenna system comprises a first antenna with a first operating frequency and a second antenna with a second operating frequency. The second antenna has a first near field with a first near region in which the first antenna is disposed and a second near region. The second antenna has a first gain in the first near region which is lower than a second gain in the second near region. The first gain and the second gain are both at a same one of the first operating frequency and the second operating frequency.

According to another embodiment of the present invention, an antenna system comprises a first antenna with a first operating frequency and a second antenna with a second operating frequency. The second antenna has a near field with a first near region in which the first antenna is disposed and a second near region. The second near region is spaced from the second antenna by about a distance d, and the first near region is spaced from the second antenna by about the distance d. The second antenna has a first gain in the first near region which is lower than a second gain in the second near region. The first gain and the second gain are both at a same one of the first operating frequency and the second operating frequency.

According to another embodiment of the present invention, a method for reducing self jamming in a multiple antenna system comprises the step of providing a first antenna with a first operating frequency. The first antenna has a near field with a first near region and a second near region. The first antenna has a first gain in the first near region which is lower than a second gain in the second near region. The first gain and the second gain are both at a same one of the first operating frequency and a second operating frequency. The method further comprises the step of providing a second antenna with the second operating frequency in the first near region of the near field of the first antenna.

Additional features and advantages of the invention will be set forth in the description below, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

Figure 1:
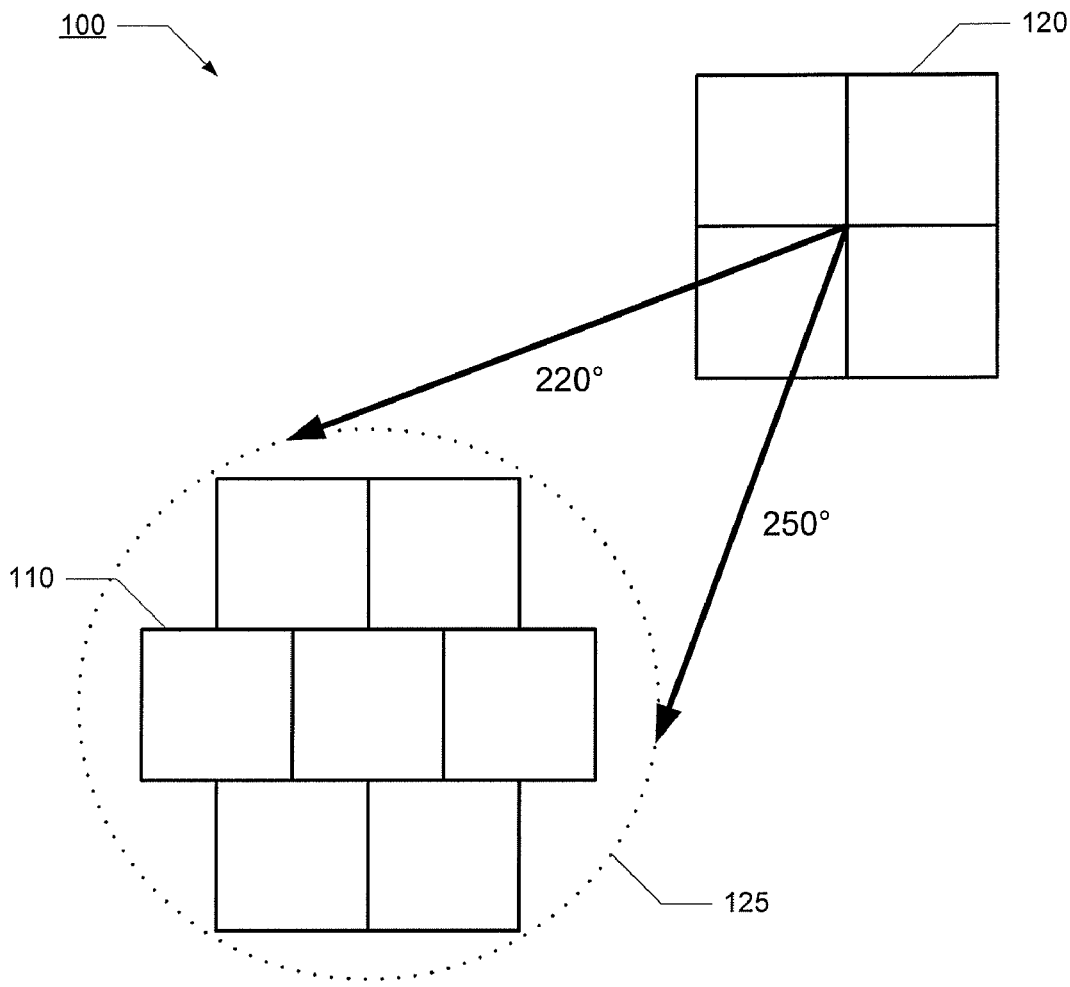
FIG. 1 illustrates an antenna system in accordance with one embodiment of the present invention.

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

In most phased array communications systems, the phase/amplitude states of the phase/amplitude control circuits are selected to form a beam which provides high gain in the direction towards a desired point or region at some distance from the antenna. The process of selecting and applying the phase/amplitude states of the phase/amplitude control circuits to form a desired beam shape is sometimes referred to as beamforming.

In some applications it may also be necessary to provide low antenna gain towards selected points or regions which are also some distance from the antenna. For example, in the geostationary satellite communications industry, it is common to collocate satellites serving different continents. Satellites serving North America are typically required to have low antenna gain towards South America. This ensures that the signals transmitted by the satellite serving North America do not interfere with ground terminals located in South America and which are pointed to the collocated satellites. It also ensures that the signals being transmitted by the ground terminals located in South America (which illuminate both of the collocated satellites) do not interfere with the signals from North American ground terminals which are being collected by the satellite serving North America. Beamforming techniques to provide high antenna gain in certain directions and low antenna gain in other directions will be readily understood by those of skill in the art.

The physics which defines the beamshape of a phased array as a function of the relative phase/amplitude of each radiating element in the array depends on the distance and angle from the antenna to the measurement point. For distances beyond a certain threshold (called the "far field") as measured from the antenna, the antenna beam shape no longer depends on distance, but rather only depends on the angle. According to one aspect, by way of illustration, and not by way of limitation, this threshold can be $2D^2/\lambda$, where D is the antenna length or diameter, and $\lambda$ is the wavelength associated with the measurement frequency. By way of example, and not by way of limitation, for phased arrays on a geostationary communications satellite, the far field begins, for example, about 100 to 1,000 feet from the antenna. Accordingly, antennas located on the same spacecraft will typically be in each other's "near field" (i.e., at a distance less than the threshold distance).

Beamforming for arrays is readily performed for regular grid arrays using a number of techniques. Using FFT-based techniques, the number of matrix vector operations for beamforming is proportional to N log(N) where N is the number of array elements and N beams are formed. Interference suppression for interferers in the far-field of array antennas where the number of interferers is known (and the steering vector associated with each interferer) is well understood by those of skill in the art and readily performed by generating and applying a matrix using the linear constraints provided by the interferer locations to the element space data to generate nulls at the interferer locations.

According to one aspect of the present invention, two electrically scanned phased arrays (ESA) in close proximity can enjoy reduced self interference by applying near-field nulling to the electromagnetic field in the plane of the array apertures. This technique can be implemented iteratively by placing nulls using conventional beam forming, by inverse imaging the beam domain to the near-field distance of the array and applying near-field amplitude constraints, thus generating a "near-field null." The technique has minimal impact on the array performance if the main beam is not steered in a direction that causes grating lobe onset in the region of nulling.

This technique can be applied to any transmit and receive array combination located on ground based, airborne or space borne platforms.

In accordance with one aspect of the present invention, antenna patterns are provided with high gain (and possibly low gain) region(s) in the far field, which also have low gain region(s) in the near field at another antenna. With this arrangement, it is possible to form the resultant beams in a manner which results in very similar far field beam quality to beams optimized only for far field performance. According to one aspect of the present invention, the antenna forming the beam with a near field low gain region as well as desired far field coverage may be a direct radiating phased array or a reflector with a feed array. The other antenna may be a phased array, an array fed reflector or another form of antenna.

For example, FIG. 1 illustrates an antenna system in accordance with one embodiment of the present invention. Antenna system 100 includes a first array antenna 110 and a second array antenna 120. Second array antenna 120 has a near field, in a region 125 of which first array antenna 110 is disposed. By way of example, and not by way of limitation, the near region 125 of second array antenna 120 is between the azimuth angles of 220° and 250° over a range of distances in which first array antenna 110 is located. In near region 125, second array antenna 120 has a low gain in a frequency at which one of first array antenna 110 and second array antenna 120 operates. For example, the gain of second array antenna 120 in the operating frequency of first array antenna 110 in near region 125 may be lower than a gain of second array antenna 120 in another region of the near field of second array antenna 120 (e.g., in a region of the near field in which first array antenna 110 is not disposed). Alternatively, the gain of second array antenna 120 in the operating frequency of second array antenna 120 in near region 125 may be lower than a gain of second array antenna in another region of the near field of second array antenna 120. For example, in accordance with one aspect of the present invention, the gain of second array antenna 120 in the operating frequency of first array antenna 110 in near region 125 may be 30 dB less than a gain in another region of the near field of second array antenna 120, as illustrated in greater detail below. With proper configuration, as set forth below, this gain may be 40 dB or even 50 dB less than other regions in the near field, dramatically reducing the effect of self-jamming on first array antenna 110. According to one aspect of the present region, the other region of the near field of second array antenna 120 to which the nulled region is compared may be at a same distance d from the second array antenna 120.

According to one aspect of the present invention, near region 125 has a volume larger than that of first array antenna 110. For example, first array antenna 110 is a series of 7 panels with outside dimensions of approximately 955 mm by 1104 mm. Accordingly, near region 125 may be a region with a diameter of greater than about 1100 mm. While near region 125 is illustrated with a circular dotted line, it will be apparent to one of skill in the art that near region 125 need not be circular or spherical. Rather, near region 125 may be any shape, as illustrated as an example with respect to FIG. 12.

In accordance with one aspect of the present invention, first array antenna 110 may be either a transmit antenna or a receive antenna, and second array antenna 120 may be either a receive antenna or a transmit antenna. In another aspect of the present invention, the antennas of an antenna system may not be array antennas.

According to one aspect of the present invention, first and second array antennas 110 and 120 operate in closely adjacent frequency bands. By way of example, and not by way of limitation, in an embodiment in which first array antenna 110 is a transmit antenna and second array antenna 120 is a receive antenna, first array antenna 110 may operate between 7.9 GHz and 8.4 GHz, and second array antenna 120 may operate between 7.25 GHz and 7.75 GHz. The ability to operate adjacent antennas in such closely adjacent frequency bands is but one advantage of the present invention, as will be illustrated in greater detail below. In accordance with one aspect of the present invention, first array antenna 110 and second array antenna 120 may operate in a cross-frequency nulling mode, in which second array antenna 120 has a nulled near region in which second array antenna 120 has a low gain in the first operating frequency. In an alternative embodiment, first array antenna 110 and second array antenna 120 may operate in a co-frequency nulling mode, in which second array antenna 120 has a nulled near region in which second array antenna 120 has a low gain in the second operating frequency. In embodiments in which first and second antennas operate in closely adjacent frequency bands, a cross-frequency nulling mode may provide some of the additional benefits of a co-frequency nulling mode (as the operating frequencies are so close, the nulled portion of the spectrum may comprise part or all of both first and second operating frequencies).

Figure 2:
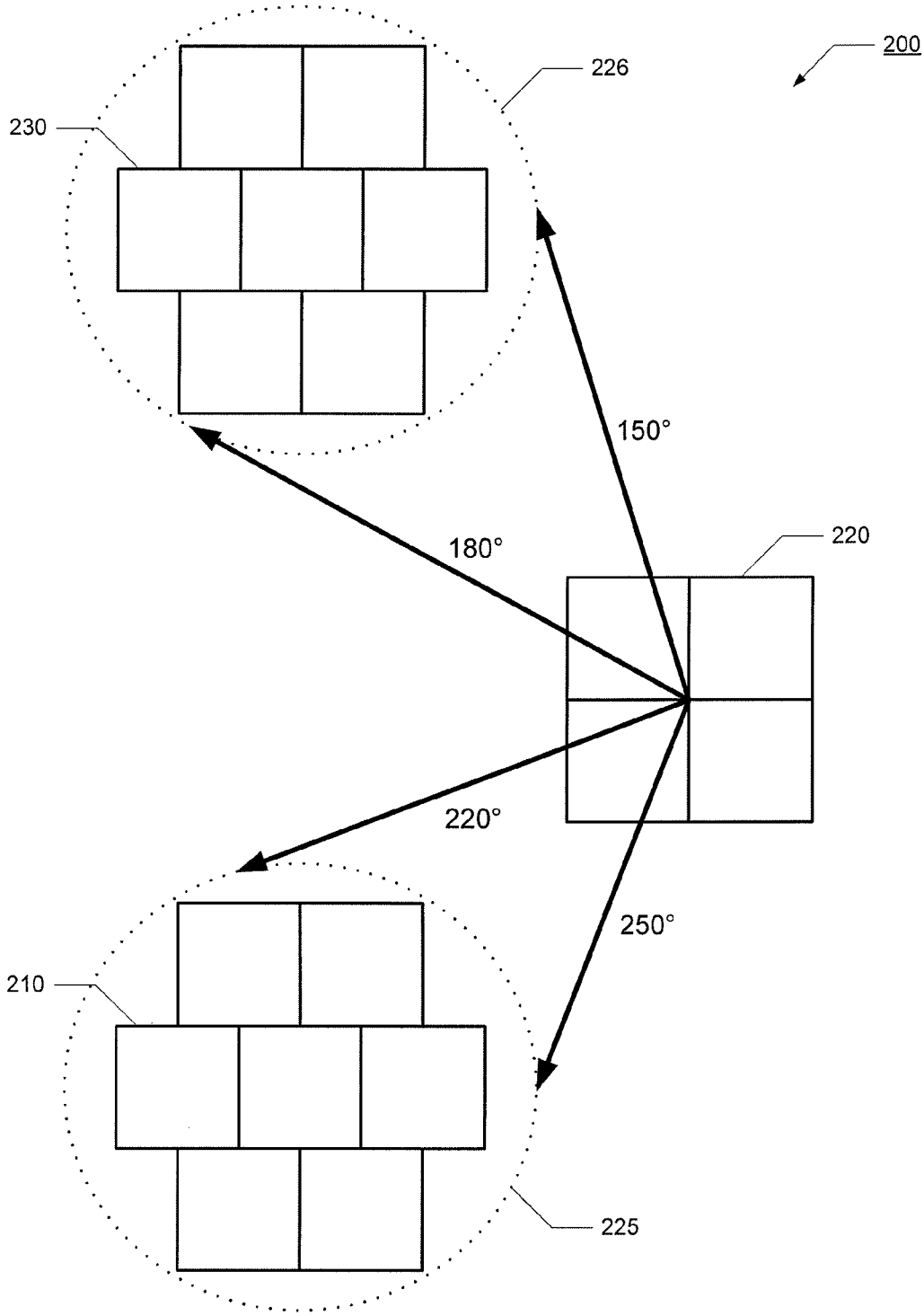
FIG. 2 illustrates a three-antenna system in accordance with one embodiment of the present invention.

As will be apparent to those of skill in the art, the present invention is not limited to antenna systems having only two antennas. Rather, an antenna system may include multiple antennas disposed in the nulled near fields of one or more additional antennas. For example, FIG. 2 illustrates a three-antenna system in accordance with one embodiment of the present invention. Antenna system 200 includes a first array antenna 210, a second array antenna 220 and a third array antenna 230. Second array antenna 220 has a first near field in a region 225, in which first array antenna 210 is disposed. By way of example, and not by way of limitation, the first near region 225 of second array antenna 220 is between the azimuth angles of 220° and 250° over a range of distances in which first array antenna 210 is located. Second array antenna 220 also has a second region 226 in its near field in which third array antenna 230 is disposed. By way of example, and not by way of limitation, the second near region 226 of second array antenna 220 is between the azimuth angles of 150° and 180° over a range of distances in which third array antenna 230 is located. Near regions 225 and 226 have a lower gain than another near region in the near field of second array antenna 220.

In accordance with one aspect of the present invention, a transmit antenna operates at a transmit frequency to form a beam with appropriate far field high and low gain regions and also with a low gain region in the near field in the direction towards and at the distance of a receive antenna. In general, more than one low gain region may be formed to reduce interference directed towards more than one nearby receive antenna. For every dB that the transmit signal strength is reduced at a particular receive array, the receive antenna input filter rejection specification at the transmit frequency may be reduced by a dB. In general, this may improve the receive sensitivity (G/T) by reducing the filter loss at the receive frequency. It may also reduce the mass and cost of the receive antenna. Alternatively, the improved isolation may be used to mount the antennas closer together while maintaining satisfactory overall isolation. In some applications, this will permit the antennas to fit within a constrained area (e.g., on an automobile, boat, airplane or other vehicle), or it may result in a simpler and lower cost/mass satellite configuration.

Similarly, the receive antenna operating at a receive frequency forms a beam with appropriate far field high and low gain regions and also with a low gain region in the near field in the direction towards and at the distance of the transmit antenna. In general, more than one low gain region may be formed to reduce interference received from more than one nearby transmit antenna. For every dB that the antenna gain is reduced at a particular transmit antenna, the transmit antenna output filter rejection specification at the receive frequency may be reduced by a dB. This may improve the transmit antenna radiated power (EIRP) by reducing the filter loss at the transmit frequency. Alternatively, the transmit power may be reduced to achieve the same EIRP with lower power amplifiers and lower DC power, which reduces satellite mass and cost. It may also reduce the mass and cost of the transmit antenna. Alternatively, the improved isolation may be used to mount the antennas closer together while still maintaining satisfactory overall isolation. In some applications, this may permit the antennas to fit within a constrained area (e.g., on an automobile, boat, airplane or other vehicle), or it may result in a simpler and lower cost/mass satellite configuration.

For applications where the transmit and receive frequencies are close to each other (e.g., SHF systems), it is possible to form a beam with a transmit array which has a near field low gain region at the receive antenna at the receive frequency. This can reduce the amount of transmit spurious power at the receive frequency which reaches the receive antenna. This can simplify the transmit filters with corresponding radiated power, mass and cost benefits.

Similarly, for applications where the transmit and receive frequencies are close to each other (e.g., SHF systems), it is possible to form a beam with a receive array which has a near field low gain region at the transmit antenna at the transmit frequency. This can reduce the amount of transmit power at the transmit frequency which is collected by the receive antenna. This can simplify the receive filters with corresponding sensitivity, mass and cost benefits.

According to one aspect of the present invention, nulling a region of the near field of an antenna in which another antenna is disposed has minimal impact on the performance of the first antenna. In this regard, nulling a near region of a first antenna may leave a peak gain of the beam of the first antenna substantially unchanged. For example, nulling the near region of the first antenna by 30 dB (when compared to another region in the near field of the first antenna) may reduce the peak gain of the main beam of the first antenna by only 0.25 dB. Alternatively, nulling the near region of the first antenna by 40 dB or 50 dB may reduce the peak gain of the main beam of the first antenna by as little as 0.5 dB or 1.0 dB.

Far-Field Beamforming

In far-field beamforming, the beamformer output vector y is given by $$y=a^H x \tag{1}$$

where a is the vector of weights or steering vector for the desired beam and x is the vector of antenna outputs. Vector a maximizes the gain in a given direction. With knowledge of the interferer locations, x can be prefiltered to produce desired nulls at the interferer locations:

$$x_F=P_V^{\perp} \tag{2}$$

where $P_V^{\perp}$ is a matrix operator that projects its argument onto a subspace orthogonal to the interferer occupied subspace. $P_V^{\perp}$ is given by $$P_V^{\perp}=I-V(V^H V)^{-1}V^H \tag{3}$$

with matrix V formed by concatenating the interference steering vectors $v_1 \ldots v_k$.

In multibeaming, a large field of view is imaged at the same resolution as a single beam as a means to image widely separated sections of the field of view simultaneously. The multibeam version of the beamformer output vector y is given by $$y=Bx \tag{4}$$

where, B is the beamforming matrix. In FFT beamforming, the matrix operator is the discrete Fourier transform implemented using the FFT as $$y=\mathrm{FFT}\{x\}.$$

FFT multibeaming with spatial projections $P_V^{\perp}$ can be decomposed as $$P_V^{\perp}=I-P_V \tag{5}$$

where $$P_V^{\perp}=V(V^H V)^{-1}V^H. \tag{6}$$

$P_V$ is Hermitian and can be written in terms of its eigendecomposition $U\Lambda U^H$ where $\Lambda$ is a diagonal matrix of eigenvalues and U represents the associated eigenvectors.

The eigendecomposition of $P_V$ can be re-written as $$P_V=\sum_i u_i u_i^H \tag{7}$$

where u are columns of U associated with the non-zero eigenvalues. Using $P_V$ in this form one obtains $$y=\mathrm{FFT}\{x\}-\Sigma[u_i^H x]\mathrm{FFT}\{u_i\}. \tag{8}$$

Thus, to perform joint multibeaming and nulling, one can perform FFT beamforming first and then correct the result using similarly transformed basis vectors of the interference subspace. Each term of the correction is an additional beamformer.

In accordance with one aspect of the present invention, the FFT based beamforming method set forth above may be used to speed up beamforming, but is not required for the iterative method of near-field nulling to work. Rather, as will be apparent to those of skill in the art, any number of beamforming methods may be used in accordance with embodiments of the present invention.

According to one aspect of the present invention, the same conditions for the far-field interference conditions need to be kept in mind in the near-field nulling application (e.g., the interferers should be separated by at least the half power beamwidth of the projected aperture or undesirable distortion in the main beam can result).

Generalized Phase Retrieval Algorithm

In accordance with one aspect of the present invention, a generalized phase retrieval algorithm (GPRA), an iterative Fourier-transform algorithm, may be used to determine the wavefront aberrations in an adaptive optical system with sources with non-uniform support and may also be used to synthesize the optimal wavefront for optical beam steering and shaping.

Near-field nulling method imposes amplitude constraints on the near-field of an array antenna according to one aspect of the present invention. The GPRA method has a significant advantage in terms of synthesis time over optimization techniques but is also not required for the near-field nulling application if optimization is preferred. The far-field ripple and sidelobe structure sometimes evident in GPRA synthesized optical beams can be controlled by choosing appropriate sampling intervals and applying k-spatial filtering in the far-field domain of the GPRA.

Figure 3:
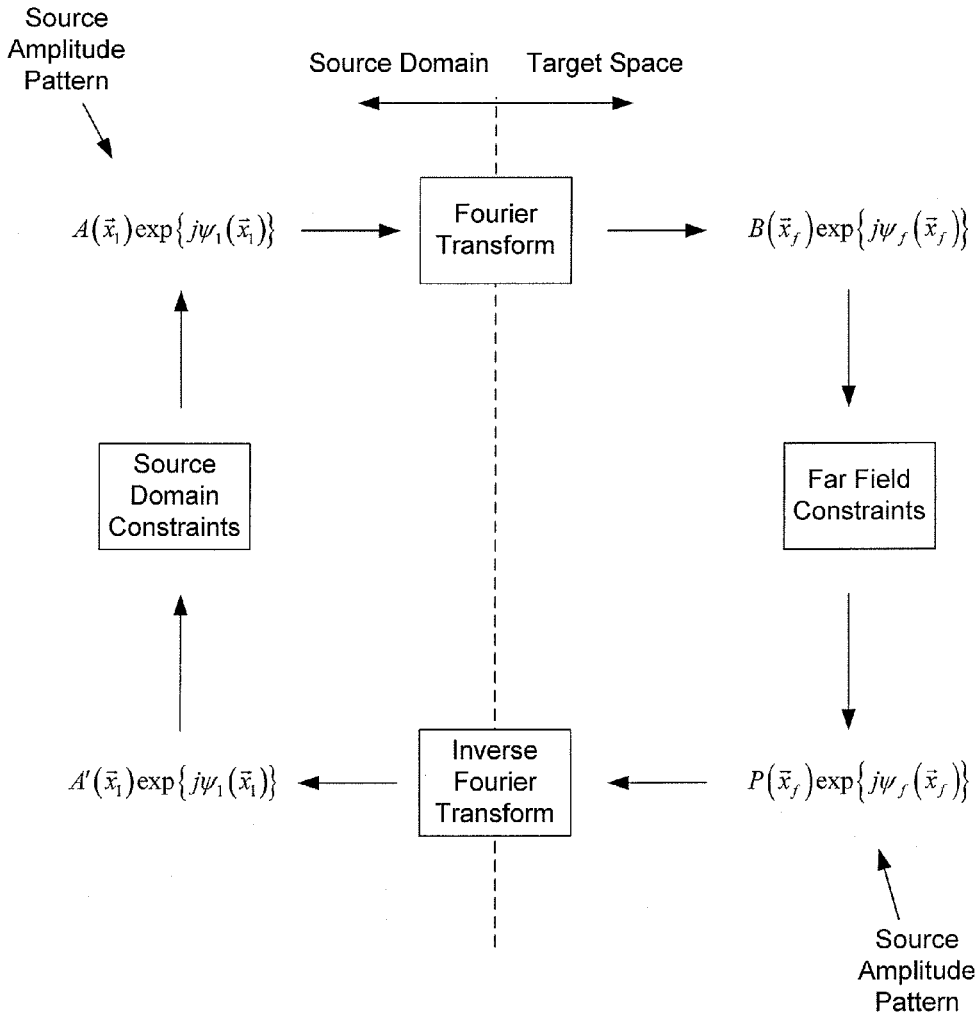
FIG. 3 is a block diagram providing an overview of a generalized phase retrieval algorithm (GPRA) in accordance with one aspect of the present invention.

According to one aspect, an iterative projection search involves Fourier transforming back and forth between object and Fourier domains with application of constraints in each domain. When generalized to include sources with non-uniform support, this iterative approach effectively yields a function with a specified amplitude which, when propagated to the Fourier transform plane, produces an approximation to a desired far field amplitude distribution. An overview of the GPRA is shown in FIG. 3, in accordance with one aspect of the present invention. The algorithm begins with an amplitude profile A, which matches the source amplitude and an initial random phase $\Psi_1(x_1)$. The field $Ae^{\{j\Psi_1(x_1)\}}$ is then propagated to the far field using a fast Fourier transform to obtain the field $B(x_f)e^{\{j\Psi_f(x_f)\}}$. The far field constraint is imposed by substituting the desired far-field amplitude pattern $P(x_f)$ for the amplitude pattern $B(x_f)$. The inverse fast Fourier transform of this field is then taken, and the amplitude is set to match the source amplitude profile A once again. This process is repeated until some measure of convergence—such as the mean squared error between $B(x_f)$ and $P(x_f)$—is achieved.

Near-Field Constraints

According to one aspect of the present invention, the radiated far-field for an aperture antenna can be expressed as $$\overline{E} = -jk\eta\frac{e^{-jkr}}{4\pi r}\left(T_0\hat{\theta} + T_\phi\hat{\phi}\right) \tag{9}$$

where $k=2\pi/\lambda$, $\rho$ is the free space impedance and $$\overline{T}(\theta, \phi) = \int_S \overline{J}(\overline{r}')e^{jk\overline{r}'\overline{y}}\,dS \tag{10}$$

where n is the surface unit normal for the surface S where near-field reconstruction is to be performed (e.g., a near field region in which another antenna is located). Taylor series expansion for the electric field for small off-boresight angles yields $$\overline{T}(u, v) = \sum_{p=0}^{p\to\infty} \frac{1}{p!}[-jk(1-\cos\theta)]^p\,\overline{T}_p \tag{11}$$

where $$\overline{T}_p = \int_S z'^p\overline{J}(x', y')e^{jkz'}e^{jk(ux'+vy')}\,dx'dy'. \tag{12}$$

Thus, the above is a sum of Fourier transform terms with dominant term:

$$\overline{T}_0 = \int_S \overline{J}(x', y')e^{jkz'}e^{jk(ux'+vy')}\,dx'dy' \tag{13}$$

Accordingly, as can be seen with reference to Equation 13, higher order terms become significant for wide angle observations.

The near-field constrains are applied to the surface S. The phase retrieval algorithm (PRA) produces a phase surface phase $\Psi_1(x_1)$. This surface is reconstructed by phase adjusting of $B(x_f)e^{\{j\Psi_f(x_f)\}}$ to produce a holographic reconstruction plane in the source volume containing the arrays. The surface profile can be extracted from this phase data. This surface approximation is used in the PRA calculation of $Ae^{\{j\Psi_1(x_1)\}}$ to ensure that the convergence is made on the actual surface profile.

Results

Figure 4:
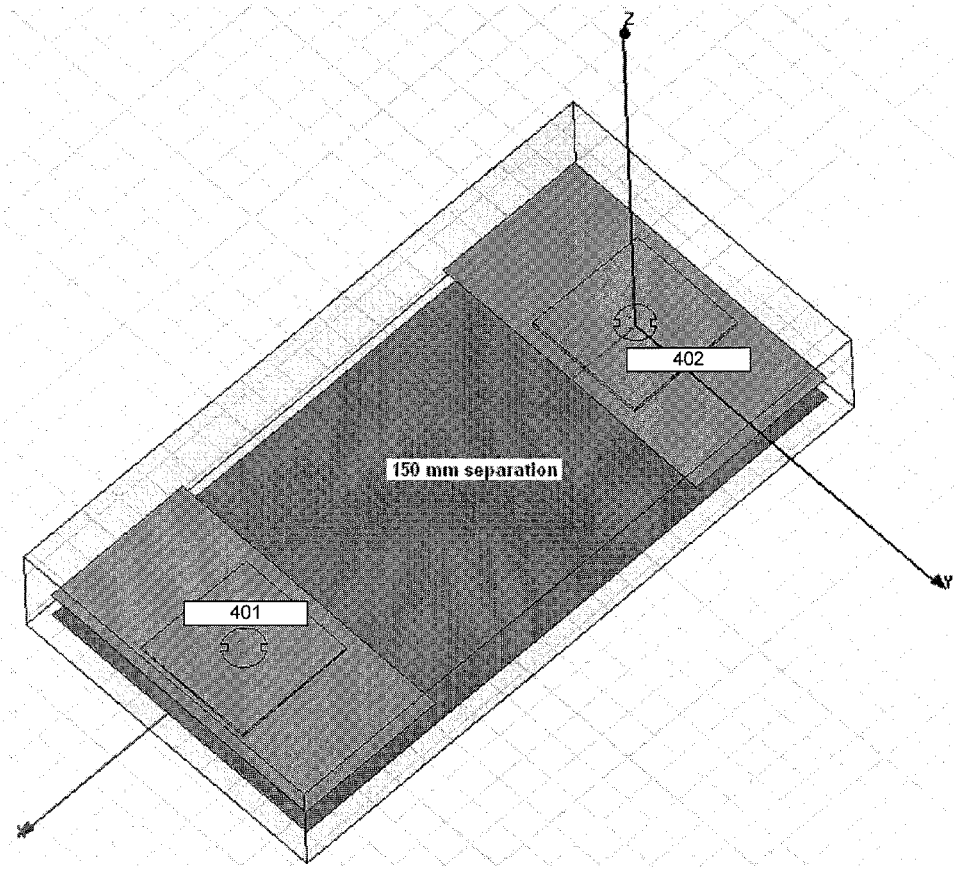
FIGS. 4 and 5 illustrate the coupling for a single element forming part of a receive array to a single element forming part of a transmit array using a full wave model, in accordance with one embodiment of the present invention.
Figure 5:
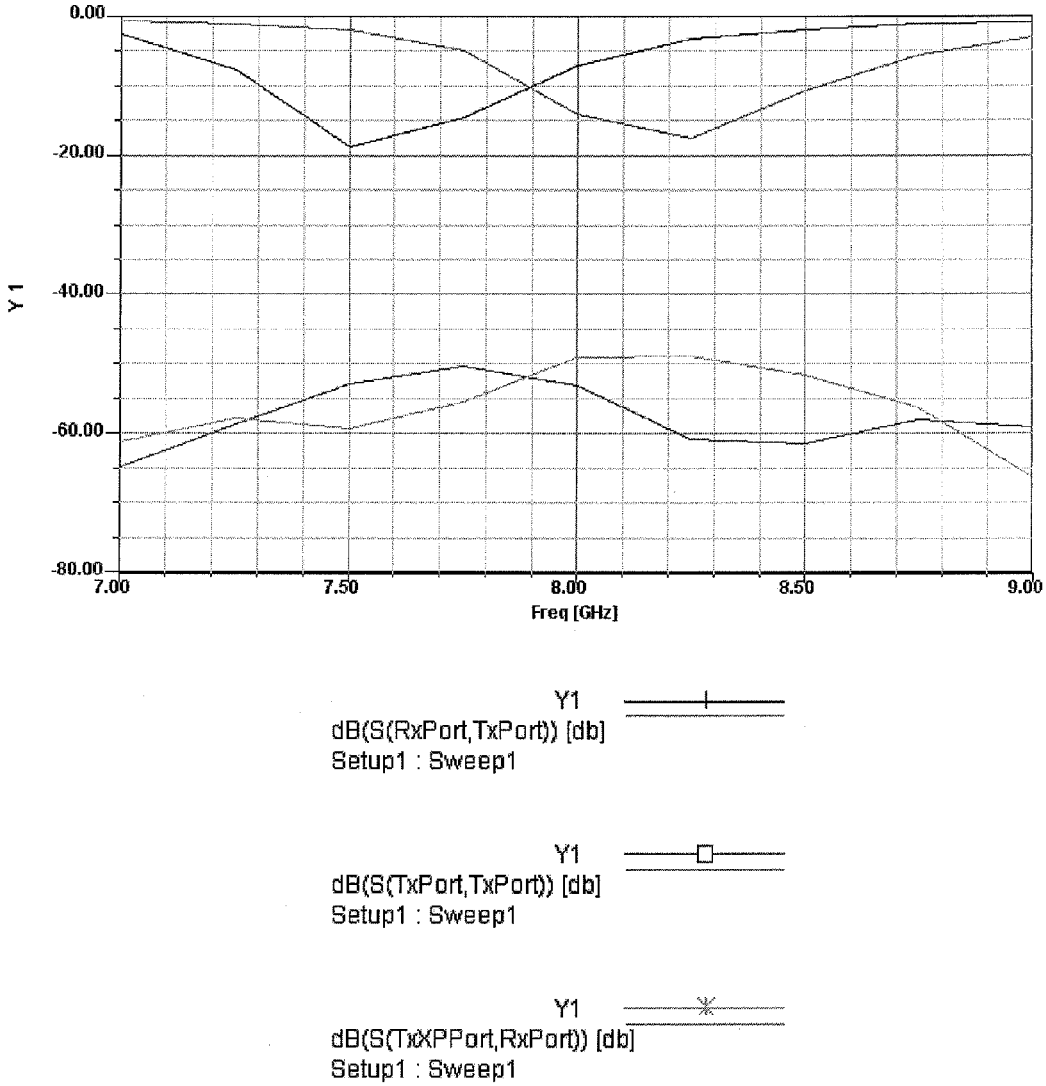

An example of transmit and receive arrays in close proximity on the roof of a vehicle is modeled to illustrate the near-field nulling technique in accordance with one aspect of the present invention. The geometry of the setup is similar to that previously described with reference to FIG. 1. FIGS. 4 and 5 show the coupling for a single element forming part of the receive array to a single element forming part of the transmit array (i.e., through Rx LHCP port 401 and Tx RHCP port 402) using a full wave model, in accordance with one embodiment of the present invention. This illustrates that the level of coupling is significant and motivates for using the near-filed nulling.

Figure 6:
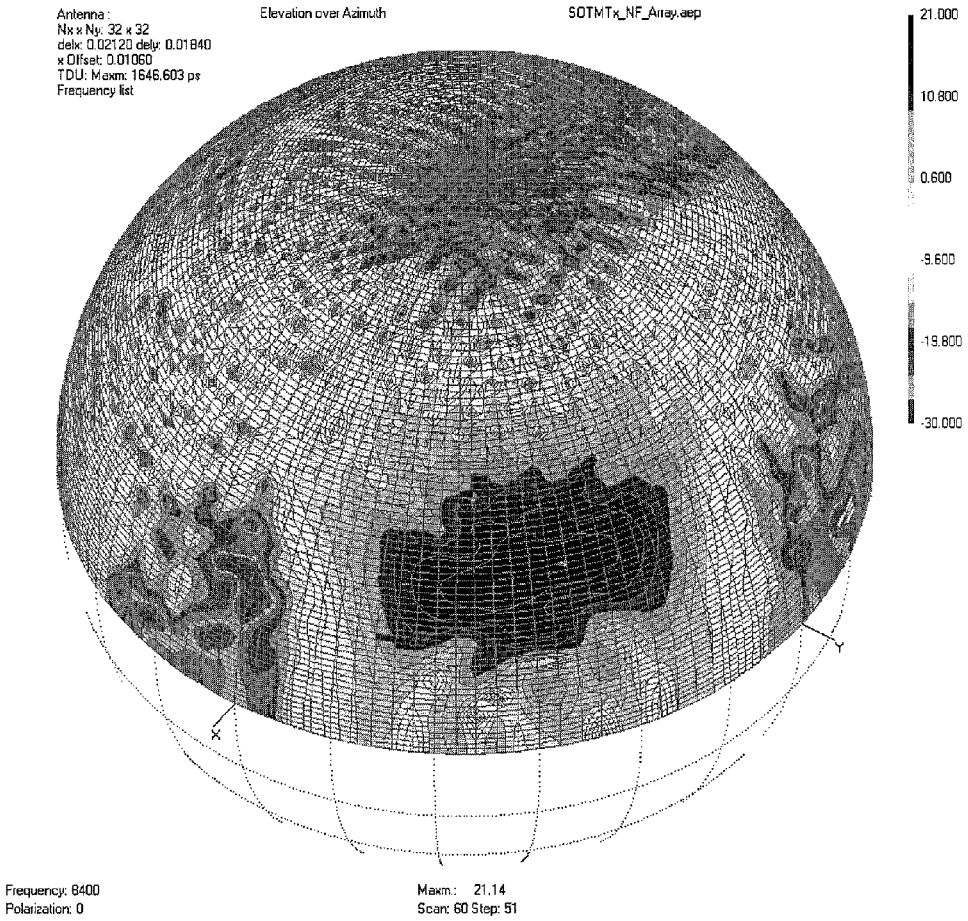
FIGS. 6 and 7 illustrate the transmit field when calculated at a near-field distance of a receive array in accordance with one aspect of the present invention.
Figure 7:
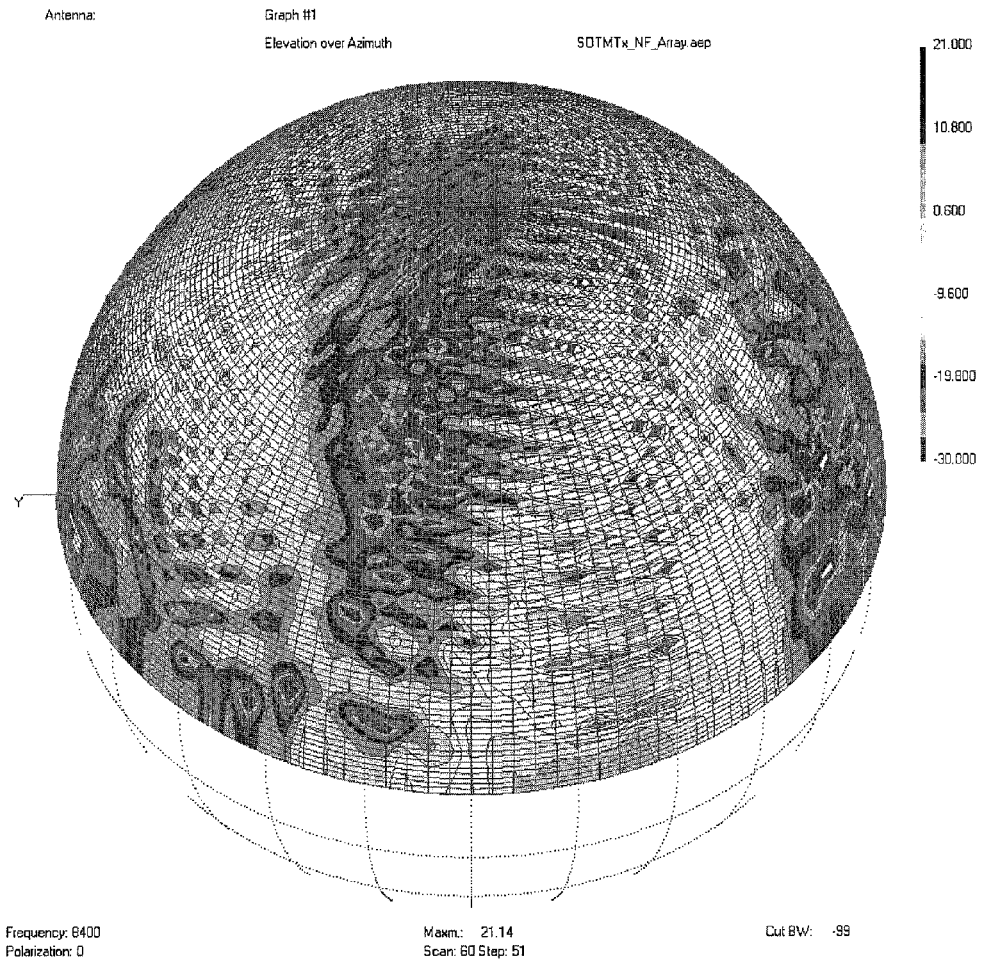
Figure 8A:
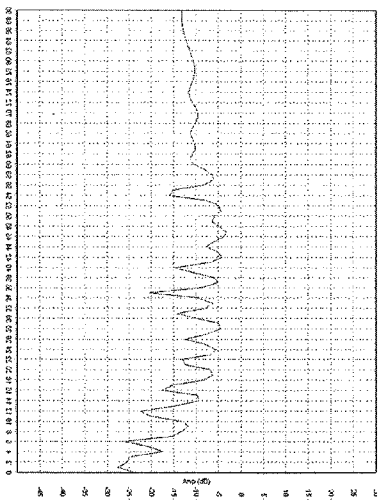
FIGS. 8*a* to 8*c* illustrate the level of coupling for the two co-located arrays with no near-field nulling applied at a variety of azimuth plane cuts, in accordance with one aspect of the present invention.
Figure 8B:
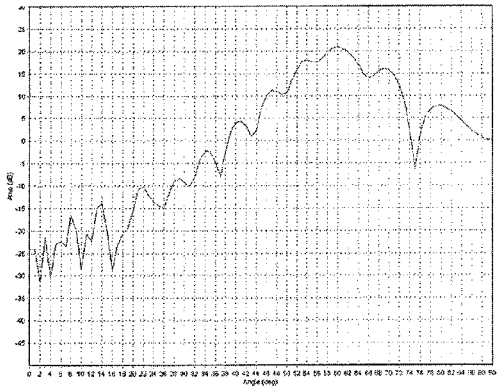
Figure 8C:
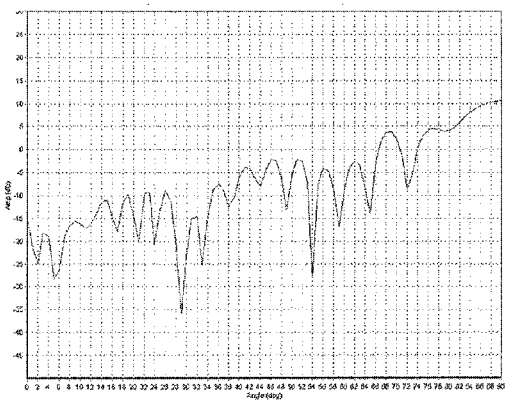

FIGS. 6 and 7 show the transmit field for this exemplary embodiment when calculated at the near-field distance of the receive array (e.g., 1.08 meters), with no near field nulling applied. This calculation assumes a uniform element pattern. FIGS. 8*a* to 8*c* illustrate the level of coupling for these two co-located arrays with no near-field nulling applied, in accordance with one aspect of the present invention. The element coupling is calculated using full wave EM code. FIG. 8*a* illustrates the coupling for the azimuth plane cut where $\phi=45°$, and FIG. 8*b* illustrates the coupling for the azimuth plane cut where $\phi=225°$. As can be seen with reference to FIGS. 8*a* and 8*b*, the maximum coupling in these two azimuth plane cuts is about 21.1 dBi. FIG. 8*c* illustrates the coupling for the azimuth plane cut where $\phi=210°$, for which the maximum coupling is about 10.5 dBi. Without applying near-field nulling, the coupling (and the self-jamming) between the co-located arrays is quite high.

Figure 9:
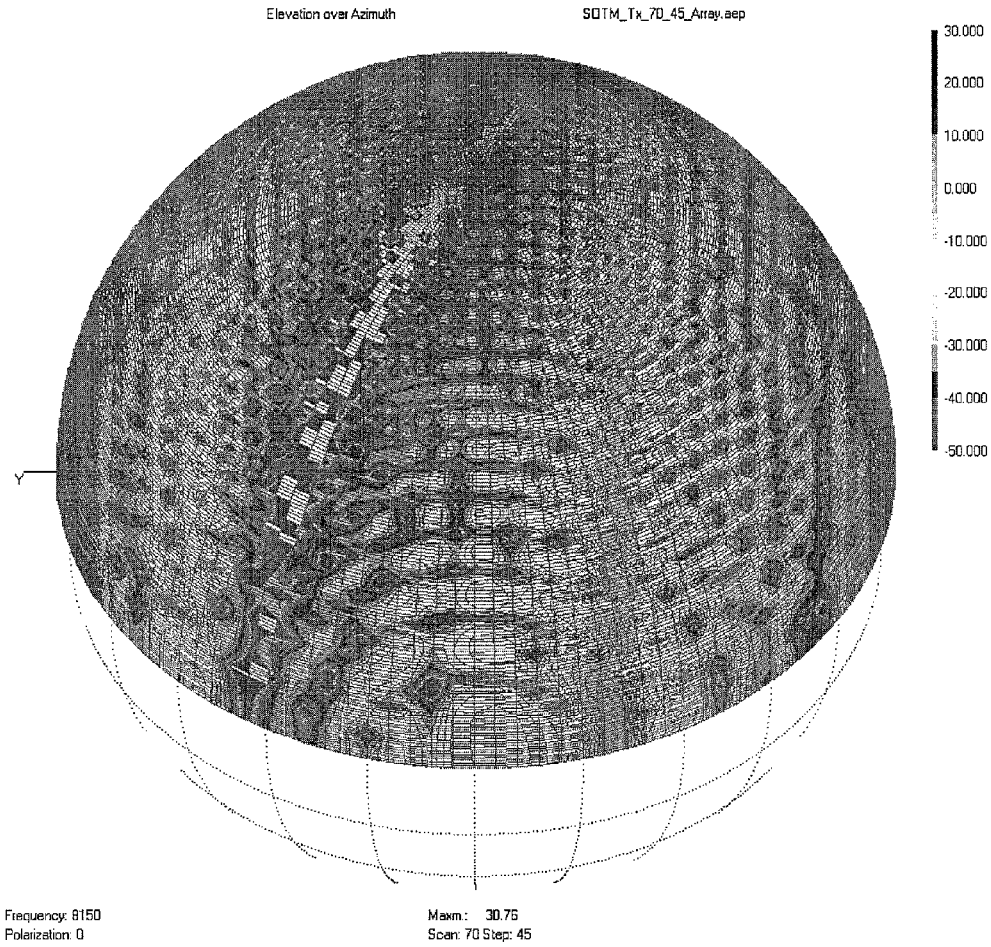
FIGS. 9 and 10 show the effect of nulling on the far-field of the transmit array in the direction of the receive array, in accordance with one aspect of the present invention.
Figure 10:
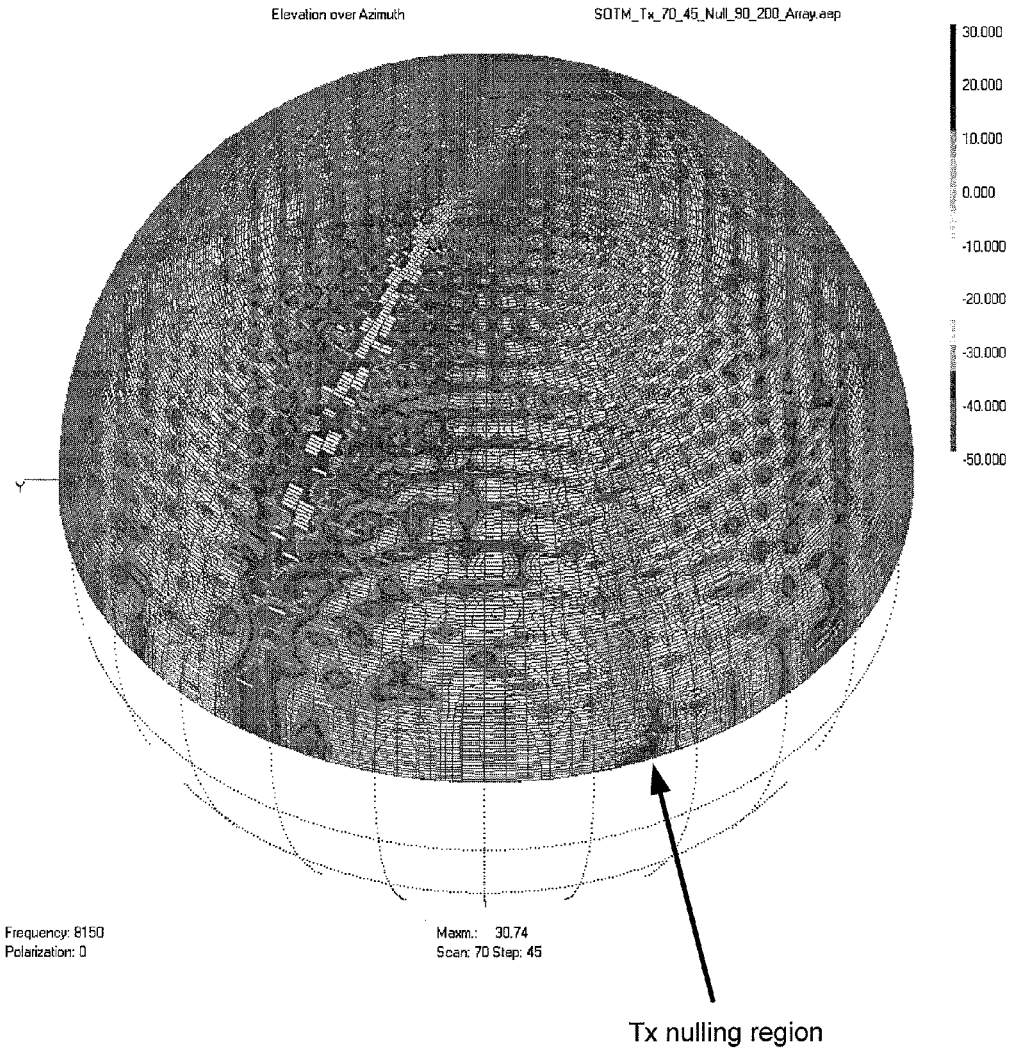
Figure 11:
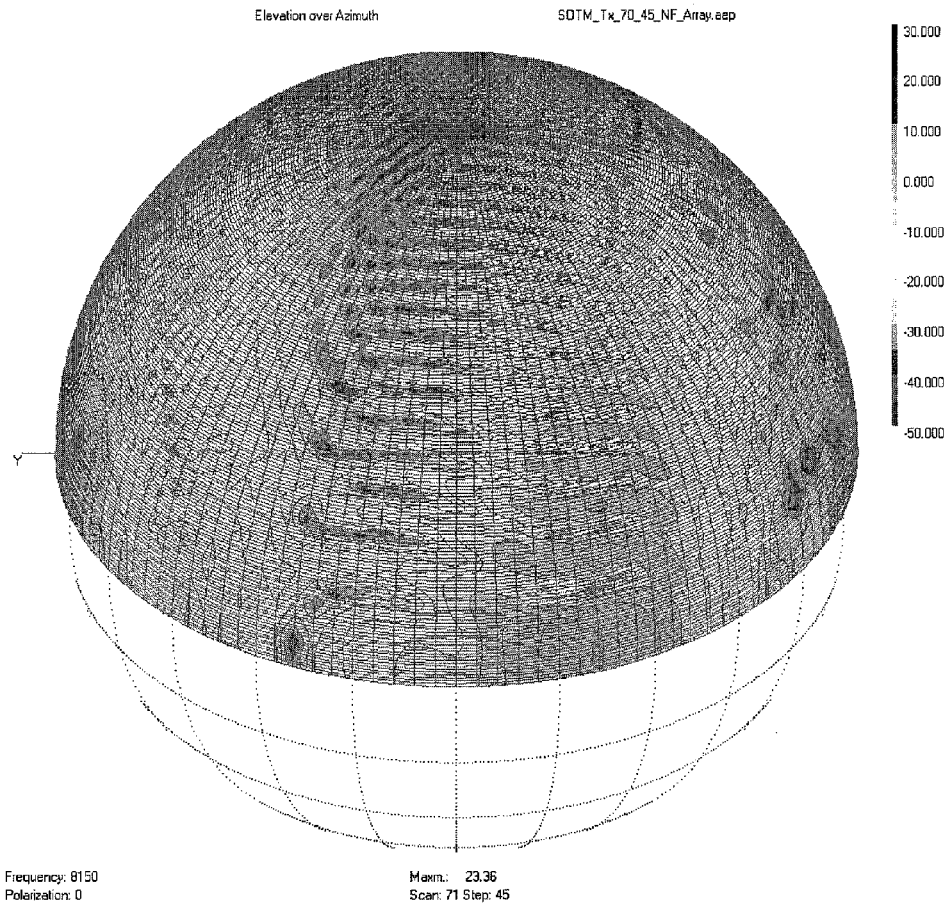
FIGS. 11 and 12 show the near-field nulled region at the distance of the receive array, in accordance with one aspect of the present invention.
Figure 12:
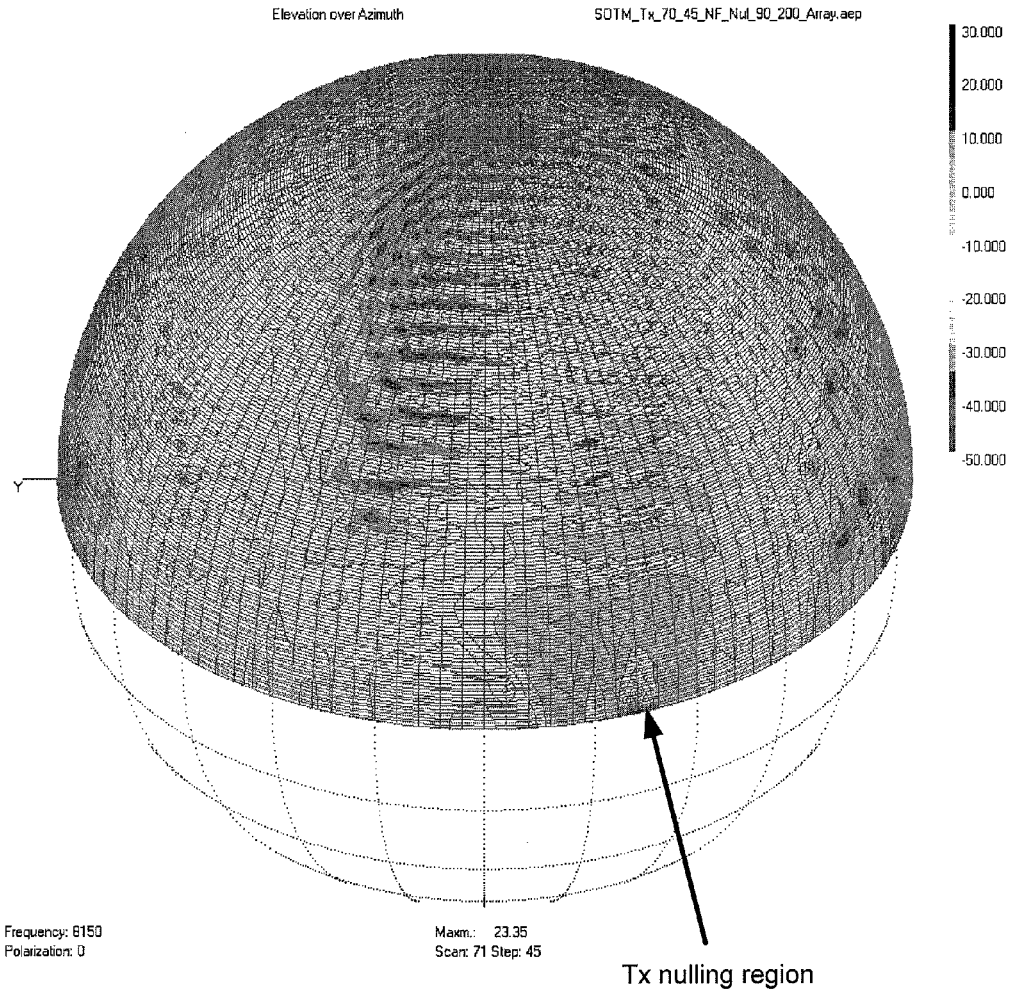

FIGS. 9 and 10 show the effect of nulling on the far-field of the transmit array in the direction of the receive array, in accordance with one aspect of the present invention. In these figures, the ideal excitation grating lobe region is illustrated when the beam is steered to (70°, 45°) without (in FIG. 9) and with (in FIG. 10) self jamming nulling applied. As can be seen by comparing FIGS. 9 and 10, in the main beam region the effect is insignificant. FIGS. 11 and 12 show the near-field nulled region at the distance of the receive array (1.2 meters), in accordance with one aspect of the present invention. In these figures, the ideal excitation grating lobe region is illustrated when the beam is steered to (70°, 45°) without (in FIG. 11) and with (in FIG. 12) self jamming nulling applied As can be seen by comparing FIGS. 11 and 12, the coupling term can be reduce by 40-50 dB in the plane in which the arrays are located.

Figure 13A:
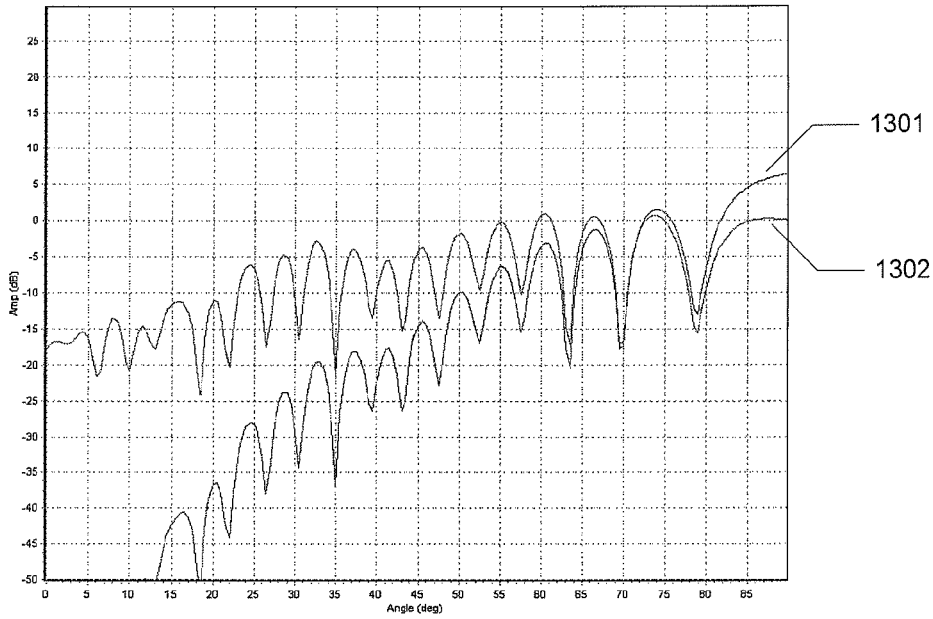
FIGS. 13*a* and 13*b* illustrate a transmit array far-field cut with and without near-field nulling applied, in accordance with one aspect of the present invention.
Figure 13B:
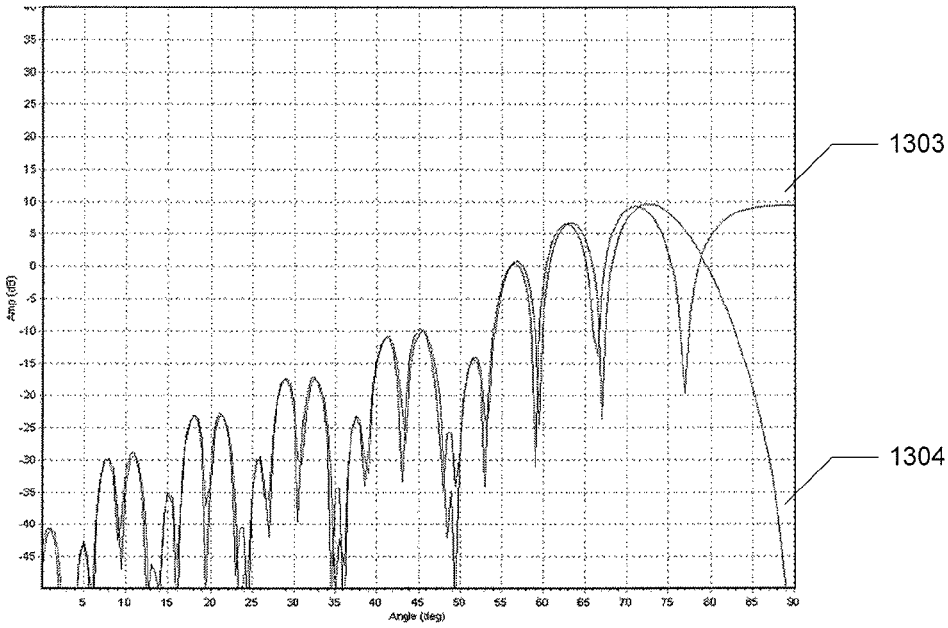

FIGS. 13*a* and 13*b* illustrate a Tx array far-field cut at $\phi=200°$ for the ideal excitation case in accordance with one aspect of the present invention. The cut illustrates the grating lobe region when the main beam is steered to (70°, 45°). In FIG. 13*a*, the gain of a antenna in RHCP 1301 and LHCP 1302 is plotted over a range of elevation angles prior to nulling. As can be seen with reference to FIG. 13*a*, at extreme angles of about 85° to 90° (i.e., approximately in the plane of the antenna, and perpendicular to the mechanical boresight of the antenna), an isolation of only about 5 dB is available to an antenna system relying entirely upon polarization to isolate adjacent antennas. In FIG. 13*b*, the gain of an antenna (in RHCP) is plotted over a range of elevation angles both before 1303 and after 1304 near field nulling is applied. As can be seen with reference to FIG. 13*b*, at extreme angles of about 85° to 90°, an isolation from 30 dB to about 50 dB is available to an antenna system utilizing near field nulling (and even without different polarizations, as both plots 1303 and 1304 are for RHCP). Moreover, FIG. 13*b* illustrates how the application of near field nulling to an antenna can leave the gain of the main beam (e.g., at lower elevation angles) substantially unchanged.

Figure 14:
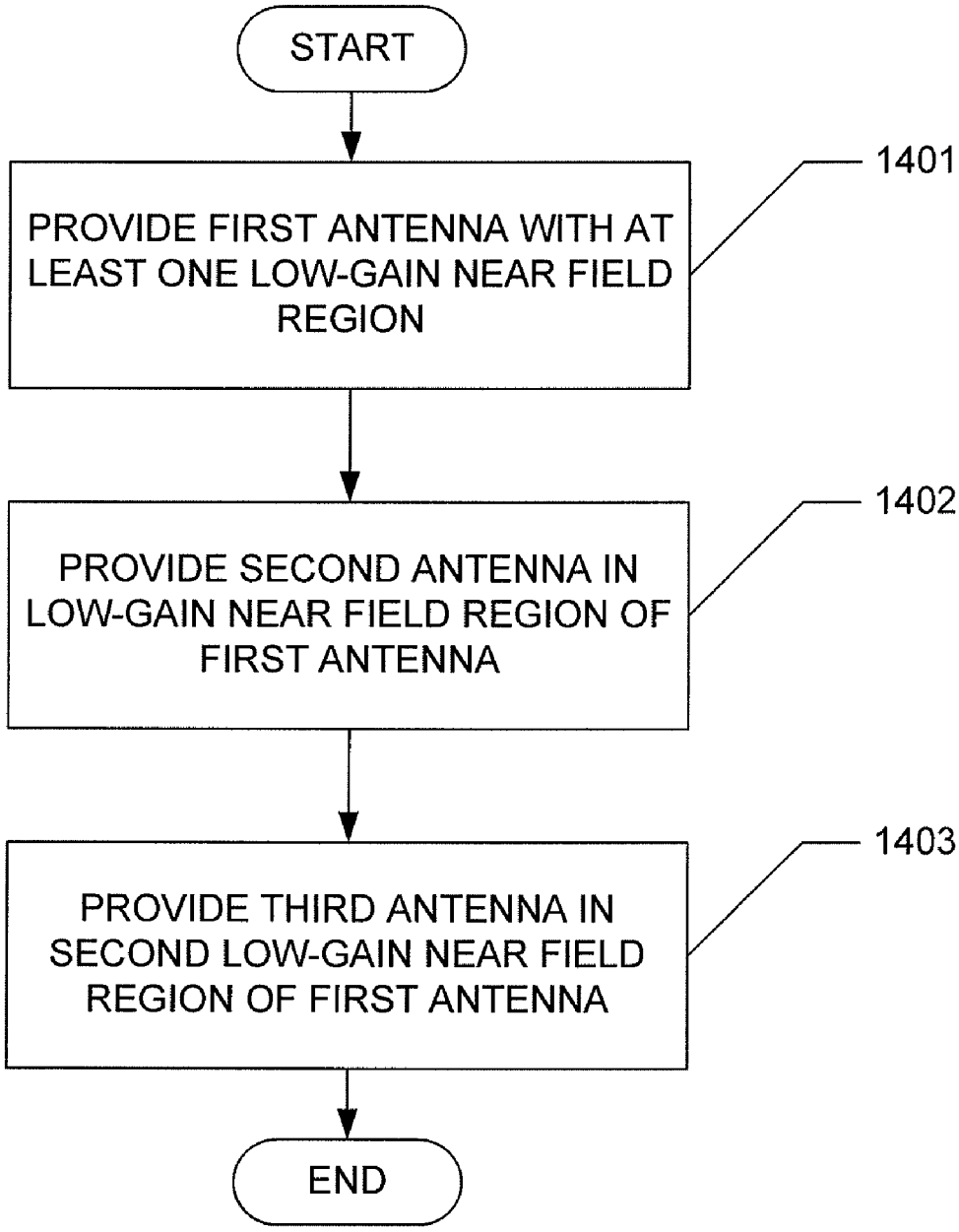
FIG. 14 is a flow chart illustrating a method for reducing self jamming in a multiple antenna system in accordance with one aspect of the present invention.

FIG. 14 is a flow chart illustrating a method for reducing self jamming in a multiple antenna system in accordance with one aspect of the present invention. The method begins with step 1401, in which a first antenna is provided. The first antenna has a first operating frequency and a near field. The near field has a near region in which the first antenna has a first gain which is lower than a second gain in another region of the near field. The first and second gain are both at the same one of either the first operating frequency or a second operating frequency. In step 1402, a second antenna is provided. The second antenna operates in the second operating frequency, and is disposed in the near region of the near field of the first antenna. In step 1403, a third antenna may optionally be provided. The third antenna has a third operating frequency, and is disposed in a second near region of the near field of the first antenna. The third antenna has a gain in the second near region, which is lower than the second gain of the first antenna. The third gain and the second gain are both at the same one of either the first operating frequency, the second operating frequency or the third operating frequency.

According to one aspect of the present invention, near-field nulling may be implemented for self-interference reduction using a phase retrieval algorithm. In accordance with another aspect of the invention, the required nulling may be obtained using any means, including, for example, optimization with suitable near-field amplitude constraints applied.

The description of the invention is provided to enable any person skilled in the art to practice the various embodiments described herein. While the present invention has been particularly described with reference to the various figures and embodiments, it should be understood that these are for illustration purposes only and should not be taken as limiting the scope of the invention. For instance, various numerical ranges such as the ranges for the far field, near region and operating frequencies are provided by way of example and not by way of limitation.

There may be many other ways to implement the invention. Various functions and elements described herein may be partitioned differently from those shown without departing from the spirit and scope of the invention. Various modifications to these embodiments will be readily apparent to those skilled in the art, and generic principles defined herein may be applied to other embodiments. Thus, many changes and modifications may be made to the invention, by one having ordinary skill in the art, without departing from the spirit and scope of the invention.

A reference to an element in the singular is not intended to mean "one and only one" unless specifically stated, but rather "one or more." The term "some" refers to one or more. Underlined and/or italicized headings and subheadings are used for convenience only, do not limit the invention, and are not referred to in connection with the interpretation of the description of the invention. All structural and functional equivalents to the elements of the various embodiments described throughout this disclosure that are known or later come to be known to those of ordinary skill in the art are expressly incorporated herein by reference and intended to be encompassed by the invention. Moreover, nothing disclosed herein is intended to be dedicated to the public regardless of whether such disclosure is explicitly recited in the above description.

What is claimed is:

1. An antenna system comprising:

a first antenna with a first operating frequency; and a second antenna with a second operating frequency, the second antenna having a first near field, the first near field having a first near region in which the first antenna is disposed, the first near field having a second near region, the second antenna having a first gain in the first near region which is lower than a second gain in the second near region, the first gain and the second gain both being at a same one of the first operating frequency and the second operating frequency.

2. The antenna system of claim 1, wherein the first antenna has a second near field, the second near field having a third near region in which the second antenna is disposed, the second near field having a fourth near region, the first antenna having a third gain in the third near region which is lower than a fourth gain in the fourth near region, the third gain and the fourth gain both being at a same one of the first operating frequency and the second operating frequency.

3. The antenna system of claim 1, wherein one of the first antenna and the second antenna is a transmit antenna, and another of the first antenna and the second antenna is a receive antenna.

4. The antenna system of claim 1, wherein the first operating frequency is different than the second operating frequency.

5. The antenna system of claim 1, wherein the first operating frequency is between 7.25 GHz and 7.75 GHz, and wherein the second operating frequency is between 7.9 GHz and 8.4 GHz.

6. The antenna system of claim 1, wherein at least one of the first antenna and the second antenna is a phased array antenna.

7. The antenna system of claim 1, wherein the first near region has a larger volume than a volume of the first antenna.

8. The antenna system of claim 1, further comprising:

a third antenna with a third operating frequency, wherein the first near field has a third near region in which the third antenna is disposed, the second antenna having a third gain in the third near region which is lower than the second gain in the second near region, the third gain and the second gain both being at a same one of the first, second and third operating frequencies.

9. The antenna system of claim 8, wherein the third near region has a larger volume than a volume of the third antenna.

10. An antenna system comprising:

a first antenna with a first operating frequency; and a second antenna with a second operating frequency, the second antenna having a near field, the near field having a first near region in which the first antenna is disposed, the near field having a second near region, the second near region being spaced from the second antenna by about a distance d, the first near region being spaced from the second antenna by about the distance d, the second antenna having a first gain in the first near region which is lower than a second gain in the second near region, the first gain and the second gain both being at a same one of the first operating frequency and the second operating frequency.

11. The antenna system of claim 10, wherein the first gain is at least 30 dB lower than the second gain.

12. The antenna system of claim 10, wherein the second gain is a highest gain in the near field.

13. The antenna system of claim 10, wherein one of the first antenna and the second antenna is a transmit antenna, and another of the first antenna and the second antenna is a receive antenna.

14. The antenna system of claim 10, wherein the first operating frequency is different than the second operating frequency.

15. The antenna system of claim 10, wherein at least one of the first antenna and the second antenna is a phased array antenna.

16. The antenna system of claim 10, wherein the first near region has a larger volume than a volume of the first antenna.

17. A method for reducing self jamming in a multiple antenna system, the method comprising the steps of:

providing a first antenna with a first operating frequency, the first antenna having a near field, the near field having a first near region and a second near region, the first antenna having a first gain in the first near region which is lower than a second gain in the second near region, the first gain and the second gain both being at a same one of the first operating frequency and a second operating frequency; and providing a second antenna with the second operating frequency in the first near region of the near field of the first antenna.

18. The method of claim 17, wherein a peak gain in the far field of the first antenna is substantially unchanged by configuring the first antenna to operate with the first gain in the first near region.

19. The method of claim 17, wherein one of the first antenna and the second antenna is a transmit antenna, and another of the first antenna and the second antenna is a receive antenna.

20. The method of claim 17, wherein the first operating frequency is different than the second operating frequency.

21. The method of claim 17, wherein the near region has a larger volume than a volume of the second antenna.

22. The method of claim 17, further comprising the steps of:

providing a third antenna in a third near region of the near field of the first antenna, the third antenna having a third operating frequency, the first antenna having a third gain in the third near region, the third gain being lower than the second gain, the third gain and the second gain both being at one of the first, second and third operating frequencies.

* * * * *